United States Patent [19]

Prewo et al.

[11] Patent Number: 4,808,485

[45] Date of Patent: Feb. 28, 1989

[54] MICROSTRUCTURALLY TOUGHENED METAL MATRIX COMPOSITE ARTICLE AND METHOD OF MAKING SAME

[75] Inventors: Karl M. Prewo, Vernon; Vincent C. Nardone, Meriden; James R. Strife, South Windsor, all of Conn.

[73] Assignee: United Technologies Corporation, Hartford, Conn.

[21] Appl. No.: 152,780

[22] Filed: Feb. 5, 1988

[51] Int. Cl.[4] ..... B22F 3/00

[52] U.S. Cl. ..... 428/582; 419/48; 419/8

[58] Field of Search ..... 419/8, 98; 428/552

[56] References Cited

U.S. PATENT DOCUMENTS

| | | | |
|---|---|---|---|
| 3,803,702 | 4/1974 | Bratt | 419/8 |
| 4,025,313 | 5/1977 | Slaats | 419/8 |
| 4,721,598 | 1/1988 | Lee | 419/8 |

OTHER PUBLICATIONS

D. W. Kum, T. Oyama, J. Wadsworth and O. D. Sherby, *The Impact Properties of Laminated Composites Containing Ultrahigh Carbon (UHC) Steels,* J. Mech. Phys., vol. 31, No. 2, pp. 173–186, 1983.

*Primary Examiner*—Stephen J. Lechert, Jr.
*Attorney, Agent, or Firm*—Kevin E. McVeigh

[57] ABSTRACT

A microstructurally toughened ceramic-particle-reinforced metal-matrix composite article is disclosed. The article includes discrete regions of ceramic-particulate-reinforced metal matrix which enclosed within and separated from each other by a network of unreinforced metal. The article exhibits high tensile strength, high elastic modulus and high impact resistance. A process for making the article is also disclosed. The process includes positioning structural elements within a metallic container to define a plurality of discrete void spaces within the container, introducing a quantity of metallic particles or of a particulate mixture of metallic particles and ceramic particles into the void spaces, and consolidating the container, structural elements and particles to form the microstructurally toughened composite article.

6 Claims, 5 Drawing Sheets

MICROSTRUCTURALLY TOUGHENED METAL MATRIX COMPOSITE ARTICLE AND METHOD OF MAKING SAME

DESCRIPTION

1. Technical Field

This invention pertains to metal matrix composite materials and articles made therefrom.

2. Background Art

Metal matrix composites have been developed which offer high specific strength and high specific stiffness. An emerging class of metal matrix composites contain discontinuous ceramic reinforcement. The discontinuous nature of the reinforcement allows this class of metal matrix composites to be formed into complex shapes using conventional metal working processes. While discontinuous ceramic reinforced metal matrix composites exhibit increased strength and stiffness relative to the base metal, the composite materials typically exhibit substantially reduced impact resistance relative to the base metal. The lack of impact resistance translates directly into a structural reliability problem and poses a significant obstacle to the wide spread use of discontinuous ceramic reinforced metal matrix composites in load bearing applications.

What is needed in the art is material which overcomes the above problem.

DISCLOSURE OF INVENTION

A composite article which exhibits high tensile strength parallel to a first axis of the article, high elastic modulus parallel to the first axis, and high impact resistance perpendicular to the first axis is disclosed. The article comprises a plurality of metallic regions and a plurality of discrete reinforced regions. Each of the regions substantially continuously extends along the first axis of the article from a first end of the article to a second end of the article. Each of the regions adjoins at least one of the other regions and is bonded to each of the regions which it joins. Each of the reinforced regions is separated from other reinforced regions by at least one metallic region. And at least two of the reinforced regions are each enclosed in all directions perpendicular to the first axis by at least one metallic region each. The metallic regions each comprise a metal alloy and the reinforced regions each comprise a metal alloy reinforced with ceramic particle.

A process for making a composite article is disclosed. The process comprises providing a metallic container, positioning a plurality of longitudinally extending metallic tubes within the metallic container to define a plurality of discrete longitudinally extending void spaces within the container, introducing a quantity of a particulate mixture of metallic particles and ceramic particles into each of the void spaces and consolidating the metallic container, the metallic tubes, and the particulate mixture to form the composite article.

A further aspect of the disclosure involves a process for making a composite article which includes providing a metallic container, positioning a plurality of structural elements along the first axis within the container to define a plurality of discrete longitudinally extending void spaces within the container, introducing a quantity of a particulate mixture of metallic particles and ceramic particles into each of the void spaces, and consolidating the metallic container, the structural elements and the particulate mixture to form the composite article. The structural elements each comprise a ceramic particle reinforced metal matrix composite core enclosed in a metallic sheath or a mixture of metallic particles and ceramic particles enclosed within a metallic sheath.

A further aspect of the disclosure includes a process for making a composite article which includes providing a metallic container, positioning a plurality of structural elements within the metallic containers to define a plurality of longitudinally extending void spaces within the container, introducing a quantity of metallic particles into each of the void spaces and consolidating the metallic container, the structural elements and the metallic particles to form the composite article. The structural elements each comprise a ceramic particle reinforced metal matrix composite core enclosed in a metallic sheath or a mixture of metallic particles and ceramic particles enclosed within a metallic sheath.

The forgoing and other features and advantages of the present invention will become more apparent from the following description and accompanying drawings.

BREIF DESCRIPTION OF DRAWINGS

BEST MODE FOR CARRYING OUT THE INVENTION

A composite article of the present invention exhibits a complex microstructure. The microstructure of a composite rod of the present invention is shown in FIGS. 1 and 2.

Figure 1:
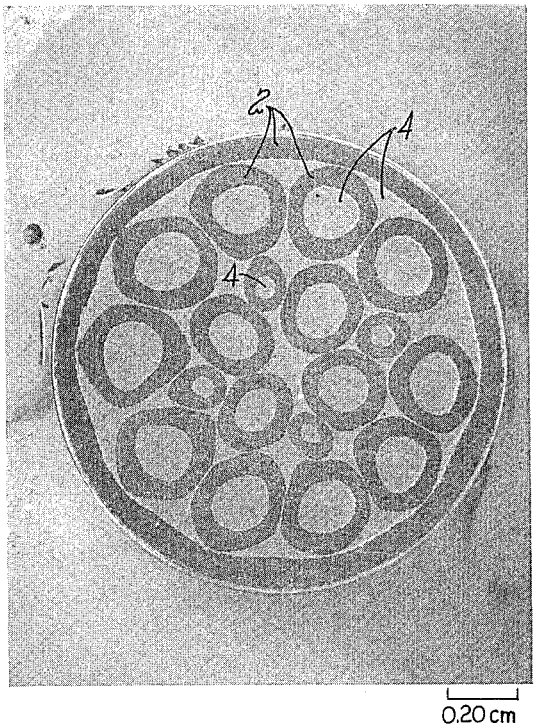
FIG. 1 shows a cross-sectional view of a composite rod of the present invention.
Figure 2:
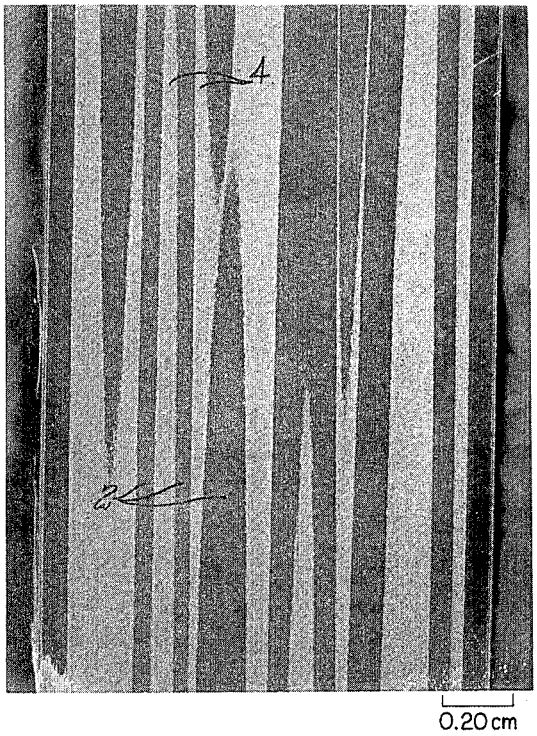
FIG. 2 shows a longitudinal sectional view of the composite rod of FIG. 1.

FIG. 1 shows a cross-sectional view of a composite rod of the present invention. A plurality of metallic regions 2 form a two-dimensional network of metallic regions 2 which separates each of a plurality of reinforced regions 4 from each of the other reinforced regions 4. Each of the discrete reinforced regions 4 is enclosed in all directions in the cross-sectional plane by at least one metallic region 2 each.

The metallic regions 2 each comprise unreinforced metal alloy. The reinforced regions 4 each comprise a metal alloy matrix reinforced with ceramic particles. The metal alloy of the reinforced region may be a different metal alloy than the metal alloy of the metallic regions. Each of the reinforced regions may comprise a metal alloy that is different from the metal alloy of the other reinforced regions. Each of the metallic regions may comprise a metal alloy that is different from the metal alloy of the other metallic regions. The composition of the respective regions is discussed in more detail below.

Each of the metallic regions and reinforced regions is contiguous with other regions and the contiguous regions are interconnected to form a coherent article. Each of the regions adjoins other regions of the article and is bonded to the regions which it adjoins to form a common interface between the adjoining regions. The common interface may be characterized by interfacial shear strength. The interfacial shear strength of each common interface is sufficiently high so that load may be transferred between the adjoining regions. It is preferred that each common interface be stable within the temperature range of intended use, and it is particularly preferred that each common interface be sharply defined. A stable interface is one which does not change over time. A sharply defined interface is an interface which provides an abrupt, rather than gradual, transition between adjoining regions. A stable, sharply defined interface between adjoining regions may be obtained if the composition of the adjoining regions is chosen so that only limited interdiffusion occurs between the adjoining regions at temperatures up to and including the intended use temperature.

While a composite article of the present invention may comprise as few as two discrete reinforced regions, improved performance may be obtained by increasing the number of reinforced regions. It is preferred that the article comprise five or more reinforced regions and it is particularly preferred that the article comprise ten or more reinforced regions.

Similarly, while a composite article of the present invention may comprise as few as two metallic regions, it is preferred that the article comprise five or more metallic regions, and it is most preferred that the article comprise ten or more metallic regions.

In the preferred embodiment shown in FIG. 1 the metallic regions 2 are each ring shaped, and the reinforced regions 4 have either a circular or an irregular cross-sectional shape. The metallic regions may have cross-sectional shapes other than the ring shape, and each of the metallic regions may have a cross-sectional shape that is different from the other metallic regions. For example, the metallic regions may have an ovoid, square, rectangular or other noncircular cross-sectional shape and may have a solid or ring-shaped cross section. The reinforced regions may have any shape complimentary to the shape of the metallic regions.

In the preferred embodiment shown in FIG. 1, a single continuous metallic region 2 defines the outer perimeter of the cylindrical rod, and a plurality of ring-shaped metallic regions 2 form a two-dimensional network of metallic regions 2 which separates each of the reinforced regions 4 from the other reinforced regions 4. It is not necessary that all reinforced regions be enclosed. While it is sufficient for purposes of the present invention that two or more reinforced regions are each completely enclosed, improved performance may be obtained by increasing the number of enclosed metal regions and it is preferred that five or more metallic regions be entirely enclosed by at least one metallic region each. For example, a composite bar machined from the composite rod shown in FIG. 1, having a square cross-sectional shape with its rectilinear perimeter defined by the unenclosed surfaces of alternating metallic regions and reinforced regions and having at least two reinforced regions which are completely enclosed is another embodiment of the present invention.

The respective regions may be arranged in spatial relationships other than that shown in FIG. 1. While it is preferred that each of the metallic regions adjoins at least two other metallic regions to form a two-dimensional network of adjoining metallic regions in the cross-sectional plane, an article of the present invention may comprise a plurality of metallic regions which do not adjoin other metallic regions. For example, a composite article comprising an alternating series of concentrically arranged ring-shaped metallic regions and ring-shaped reinforced regions is another embodiment of the present invention.

A composite article of the present invention extends along a first axis from a first end to a second end. FIG. 2 shows a longitudinal sectional view of the composite rod shown in FIG. 1. The metallic regions 2 are oriented so that each metallic region 2 extends along the longitudinal axis of the rod and the discrete reinforced regions 4 are oriented so that each reinforced region 4 extends along the longitudinal axis of the rod. While it is preferred that each region extend continuously from the first end of the article to the second end of the article, each region may extend substantially continuously from the first end of the article to the second end of the article. A region which extends substantially continuously from the first end of the article to the second end of the article may be interrupted by discontinuities as long as the discontinuities do not adversely affect the tenslle strength, elastic modulus and impact resistance of the article. Each of the regions adjoins other regions of the article and is bonded to the regions which it adjoins to form a common interface between the adjoining regions which extends along the longitudinal axis of the article.

The process of the present invention is a preferred method for fabricating the article of the present invention. Briefly, a plurality of structural elements are each positioned within a metallic container so that the container and structural elements define a plurality of longitudinally extending void spaces within the container. The structural elements may comprise a metal alloy or a composite core enclosed in a metal alloy sheath. A quantity of particles, comprising metallic particles or a particulate mixture of metallic particles and ceramic particles is introduced into the void spaces. The container, structural elements and particles are then consolidated by exposure to elevated pressure at an elevated temperature to form a composite article of the present invention.

The metallic container may be any metallic container having continuous inner surface which extends along a longitudinal axis from a closed end of the container to an open end of the container to define an internal void space. The void space is characterized by a depth which corresponds to the distance between the closed end of the container and the open end of the container and a cross-sectional dimension, for example, a diameter, which corresponds to a characteristic cross-sectional distance. It is preferred that the depth of the void space be very large relative to the cross-sectional dimension of the void space. For example, a right circular cylindrical can is suitable as the container as are similar containers having square, rectangular or other cross-sectional shapes.

The structural elements each extend longitudinally from a first end of the structural element to a second end of the structural element and may have any cross-sectional shape. Each of the structural elements may be characterized by a length, corresponding to the distance between the first end of the structural element and the second end of the structural element and by a characteristic cross-sectional dimension, for example, a diameter. It is preferred that the length of the structural elements be very large relative to the characteristic cross-sectional dimension of the structural elements The structural elements may comprise a metal alloy, a ceramic particle reinforced metal matrix, a ceramic-particle-reinforced metal matrix composite core enclosed in a metallic sheath, or a particulate mixture of metallic particles and ceramic particles enclosed within a metallic sheath. Suitable structural elements include, for example, hollow right circular cylindrical metallic tubes, solid right circular cylindrical metallic rods, as well as hollow metallic tubes or solid metallic rods having square, rectangular or other cross-sectional shapes.

The structural elements are positioned within the metallic container so that the metallic container and the structural elements define a plurality of discrete void spaces which extend along the longitudinal axis of the metallic container. For a given article, the cross-sectional dimensions of the can and of the structural elements are chosen so that a plurality of structural elements may be positioned parallel to each other within the metallic container with the longitudinal axis of each structural element oriented along the longitudinal axis of the metallic container. While it is preferred that each of the structural elements may be of the same composition, combinations of the various types of structural elements discussed above may be used. It is preferred that the structural elements are of substantially equal length and that the length of each structural element is slightly less than the depth of the void defined by the metallic container. It is preferred that the structural elements are positioned within the metallic container so that one end of each structural element contacts the closed end of the container to form a plurality of discrete void spaces extending from the ends of the structural elements which contact closed end of the container to the other ends of the structural elements and a common void space extending from the other ends of the structural elements to the open end of the container. It is preferred that the structural elements are positioned within the metallic container so that a two-dimensional network of adjoining structural elements perpendicular to the longitudinal axis of the container is obtained. Typically, each of the structural elements would contact at least two other structural members or contact at least one other structural member and the metallic container. Preferably, each of the structural elements would contact at least three other structural members or contact at least two other structural members and the metallic container so that the preferred network is formed. For example, a contiguous array of parallel tubes or a contiguous array of parallel rods may be positioned within the metallic container.

A quantity of particles comprising metallic particles or a particulate mixture of metallic particles and ceramic particles is introduced into the void spaces defined by the container and the structural elements. It is preferred that a sufficient quantity of particles be introduced to substantially fill all of the discrete void spaces within the metallic container. Preferably, the metallic container and structural element assembly is vibrated during the introduction of the particles to permit closed packing of the particles. Preferably, once the discrete void spaces of the metallic container and structural element assembly are filled the filled assembly is vacuum degassed at an elevated temperature. The assembly is then sealed by crimping the open end of the metallic container.

The metallic container containing the structural elements and the particles is consolidated by exposure to elevated pressure at an elevated temperature to form a coherent article. Conventional consolidation processes such as hot pressing, hot isostatic pressing followed by extrusion or direct extrusion consolidation may be used. The particular consolidation processing parameters depend on the composition of the particular article and will be familiar to those skilled in the art.

The consolidated article is suitable as a feedstock for subsequent working operations and may be formed into complex shapes by such conventional metal working operations as forging or machining.

The particulate mixture and the composite core of the structural elements of the process of the present invention are consolidated to form the reinforced regions of the article of the present invention. The particulate mixture, and composite cores of the process of the present invention, and reinforced regions of the article of the present invention each comprise a metal alloy matrix reinforced with ceramic particles.

Suitable metal alloy matrix materials are those metal alloys which can be formed at elevated temperatures using conventional metal working techniques. Suitable metal alloys include alloys of magnesium, titanium, nickel, niobium, aluminum and "intermetallics" such as nickel aluminide, niobium aluminide or titanium aluminide.

The metal alloy matrix of the reinforced regions is reinforced with ceramic particles. Ceramic particles which are compatible with the metal alloy matrix are suitable for use with the present invention. Compatibility with the matrix metal alloy matrix means that there is no or, at most, very limited interdiffusion between the ceramic particles and the matrix and that there is no or, at most, very limited dissolution of the ceramic particles in the matrix and that a strong bond may be formed between the ceramic particles and the matrix. The ceramic particles may be either ceramic whiskers or ceramic platelets. Suitable ceramic materials include silicon carbide, alumina, titanium diboride and boron carbide.

The metallic container and the metallic sheath of the structural elements of the process of the present invention are consolidated to form the metallic regions of the article of the present invention. The metallic container, and the metallic sheaths of the structural elements of the process of the present invention, and the metallic regions of the article of the present invention each comprise a metal alloy.

Metal alloys which are tough, ductile, workable within the same temperature range as the metal alloy matrix material, and compatible with the matrix material are suitable metal alloys for practice of the present invention. Compatibility with the matrix means that there is no or, at most, very limited interdiffusion between the metal alloy of the metallic region and the matrix at the use temperature of the article and no or, at most, very limited dissolution of either the metal alloy of the metallic region in the metal alloy matrix or of the metal alloy matrix material in the metal alloy of the metallic region. Suitable metal alloys include alloys of aluminum and titanium as well as stainless steel alloys. Each metallic region may be bounded by a layer of a metal oxide so that a stable sharply defined, interfacial boundary may be obtained between adjoining regions.

The composition and relative volumes of the metallic container, the structural elements, and the metallic particles or the particulate mixture of metallic particles and ceramic particles of the process of the present invention are chosen to provide a composite article of a particular composition.

The composite article of the present invention comprises between about 10 volume percent and about 30 volume percent ceramic particles and from about 70 volume percent to about 90 volume percent metal alloy. It is preferred that the article comprise between about 15 volume percent and about 25 volume percent ceramic reinforcement and from about 75 volume percent to about 85 volume percent metal alloy.

The reinforced regions each comprise from about 40 volume percent to about 80 volume percent metal alloy matrix and from about 20 volume percent to about 60 volume percent ceramic particles. It is preferred that the metal alloy matrix comprise from about 60 volume percent to about 80 volume percent of the reinforced regions and the ceramic particles comprise between about 20 volume percent and about 40 volume percent of the reinforced regions.

Typically, the article of the present invention comprises from about 10 volume percent to about 70 volume percent metallic regions and from about 30 volume percent to about 90 volume percent reinforced regions.

EXAMPLE 1

Three cylindrical cans made of 6061 aluminum (Al), having an outer diameter (O.D.) of 2.5 inches and a wall thickness of 0.12 inch were each filled with 14 longitudinally oriented 0.5 inch outer diameter cylindrical tubes and 4 longitudinally oriented 0.25 inch outer diameter cylindrical tubes of 6061 aluminum. Each of the tubes had a wall thickness of 0.058 inch.

Three different particulate mixtures were prepared by mixing silicon carbide particles and −325 mesh 1100 aluminum powder together in a twin container "V" mixer. The composition of each of the three particulate mixtures is given in Table I below.

Each of the three particulate mixtures was introduced into the void spaces of one of the three cans to substantially fill the can. Each of the three particulate-mixture-filled can-and-tube-assemblies was vacuum degassed for 30 minutes at 950° F. and then subjected to hot isostatic pressing at 900° F. and 15000 pounds per square inch for 3 hours, and finally extruded at 850° F. through a 0.5 inch diameter cylindrical die to form an extruded rod. The composition of each of the rods is given in Table I.

A cross-sectional view of rod 1 is shown in FIG. 1, and a longitudinal sectional view of rod 1 is shown in FIG. 2. Each view shows a plurality of metallic regions 2 separating each of a plurality of reinforced regions 4 from other reinforced regions 4 of the plurality of reinforced regions 4.

Specimens were machined from each of the extruded rods for impact testing. The averaged results of notched Charpy impact testing for three specimens is presented for each of the three extruded rods, along with comparative data for two conventional annealed particulate ceramic reinforced 6061 aluminum matrix materials.

TABLE I

| Material | Composition (volume percent) Particulate mixture | Material | Energy dissipated (ft-lb) |
|---|---|---|---|
| Rod 1 | 20 SiC/80 Al | 10 SiC/90 Al | 11.6 |
| Rod 2 | 40 SiC/60 Al | 20 SiC/80 Al | 7.6 |
| Rod 3 | 60 SiC/40 Al | 30 SiC/70 Al | 5.8 |
| Conventional | — | 20 SiC/80 Al | 4.5 |
| Conventional | — | 30 SiC/70 Al | 2.4 |

EXAMPLE 2

Figure 3:
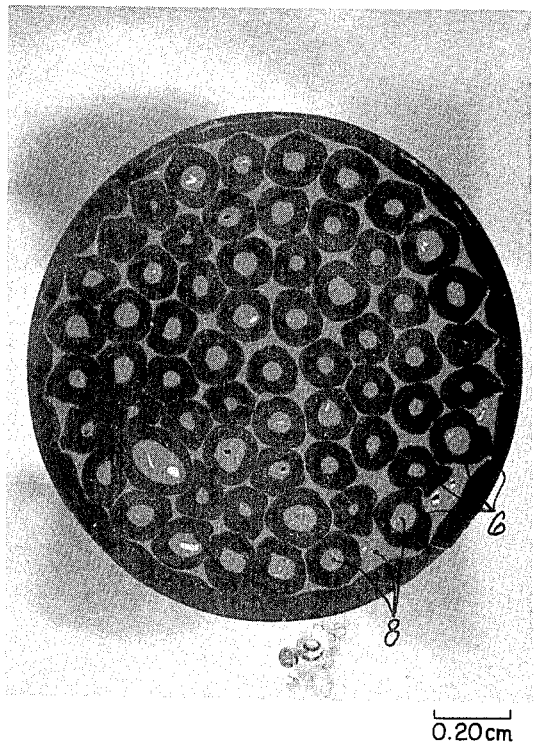
FIG. 3 shows a cross-sectional view of a second composite rod of the present invention
Figure 4:
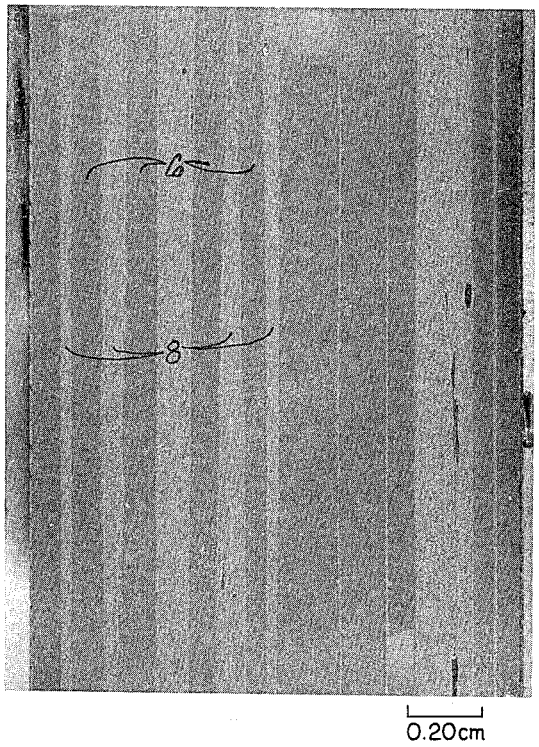
FIG. 4 shows a longitudinal view of the composite rod of FIG. 3.
Figure 5:
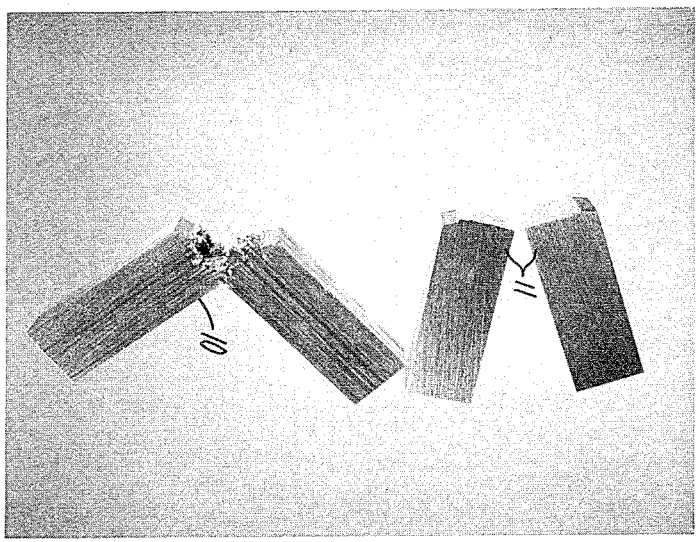
FIG. 5 shows a comparison of the fracture surfaces of a conventional particulate ceramic reinforced metal matrix composite impact specimen and an impact specimen of the present invention.

An array of 62 cylindrical tubes, each comprising 6061 Al and having an O.D. of 0.25 inches and a wall thickness of 0.065 inches were positioned within a cylindrical can, comprising 6061 Al and having an O.D. of 2.5 inches and a wall thickness of 0.12 inches. A particulate mixture consisting of 50 percent by weight 6061 Al powder and 50 percent by weight SiC particles was introduced to fill the longitudinally extending void spaces defined by the can and tubes. The can, tubes and particulate mixture assembly was vacuum degassed for 30 minutes at 950° F., subjected to hot isostatic pressing at 900° F. and 15,000 psi for 2 hours and then extruded at 850° F. through a 0.5 inch O.D. cylindrical die. A cross-sectional view of the rod is shown in FIG. 3, and a longitudinal view of the rod is shown in FIG. 4. Each view shows a plurality of metallic regions 6 separating each of a plurality of reinforced regions 8 from the other reinforced regions 8 of the plurality of reinforced regions 8.

Specimens were machined from the extruded rods for impact testing. The results of notched Charpy impact testing for each of 3 microstructurally toughened specimens are presented in Table 2, along with comparative data for a conventional 20 volume percent SiC/80 volume percent 6061 Al-T6 composite specimen. The appearance of the fracture surface of the impact specimen 10 machined from the extruded rod is compared to the appearance to the fracture surface of the impact specimen 11 of the conventional material.

TABLE 2

| Material | Energy Dissipated (ft lb) |
|---|---|
| Conventional | 0.80 |
| Microstructurally Toughened | |
| specimen 1 | 18.9 |
| specimen 2 | 14.7 |
| specimen 3 | 12.9 |

EXAMPLE 3

A cylindrical can made of 6061 aluminum having an outer diameter of 2 inches was filled with 19 longitudinally oriented cylindrical reinforcing rods. Each rod comprising a ⅜ inch O.D. particulate SiC reinforced 6061 aluminum core enclosed in a 0.011 inch thick 6061 aluminum sheath.

A quantity of −325 mesh 6061 aluminum powder was introduced to substantially fill the void spaces within the volume defined by the can.

The can filled with reinforcing rods and aluminum powder was vacuum degassed then subjected to hot isostatic pressing at 900° F. for 15000 psi for 2 hours and finally extruded at 800° F. through a ½ inch diameter cylindrical die. The rod comprised 18 volume percent silicon carbide particles and 82 volume percent 6061 Al.

Figure 6:
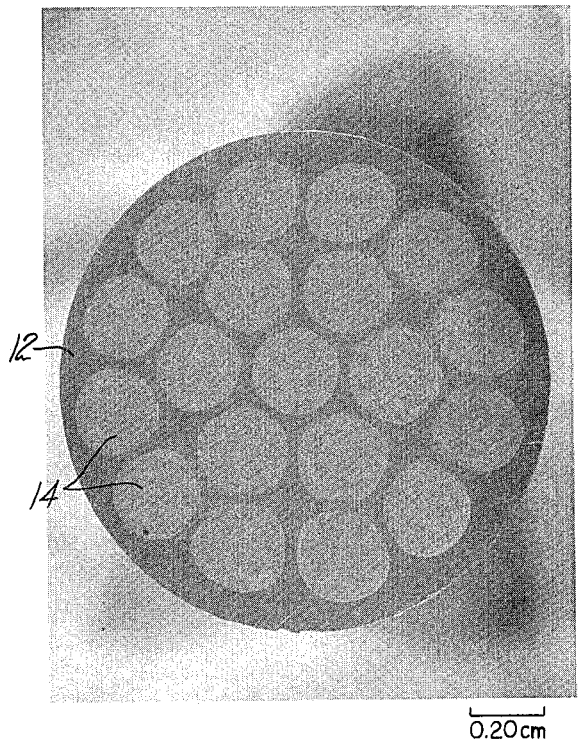
FIG. 6 shows a cross-sectional view of a third composite rod of the present invention.
Figure 7:
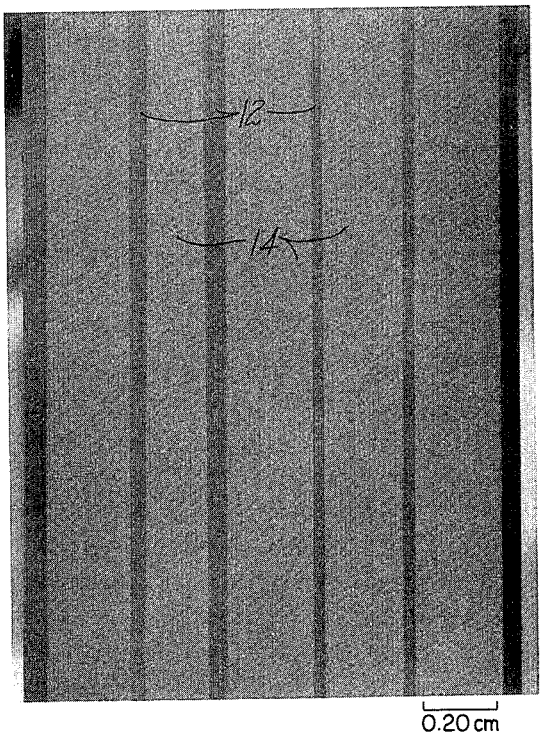
FIG. 7 shows a longitudinal sectional view of the composite rod of FIG. 6.
Figure 6A:
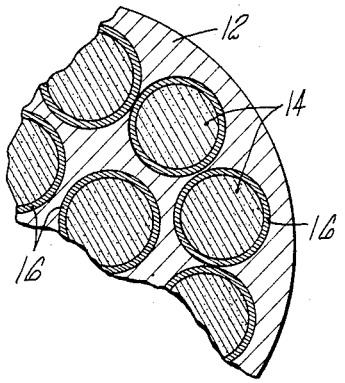
FIG. 6A shows a schematic representation of a portion of FIG. 6.

A cross-sectional view of the rod is shown in FIG. 6 and a longitudinal sectional view of the rod is shown in FIG. 7. Each view shows a network of metal regions 12 separating each of a plurality of reinforced regions 14 from the other reinforced regions 14 of the plurality of reinforced regions 14. The metallic regions of the network 12, although having the superficial appearance of a single continuous metallic region, are each distinct from each other due to the presence of internal interfaces between the metallic regions. FIG. 6A is a schematic representation of a portion of FIG. 6 and shows a plurality of metallic regions 12, a plurality of reinforced regions 14, with interfacial boundaries 16 between adjoining metallic regions 12.

Specimens were machined from the rods for impact testing. The results of notched impact testing for each of 3 microstructurally toughened specimens are given in Table 3 along with comparative data for a conventional specimen comprising 20 volume percent silicon carbide particles and 80 volume percent 6061 aluminum.

TABLE 3

| Material | Energy Dissipated (ft lb) |
|---|---|
| Conventional | 0.80 |
| Microstructurally Toughened | |
| specimen 1 | 6.5 |
| specimen 2 | 9.0 |
| specimen 3 | 6.5 |

EXAMPLE 4

An article according to the present invention which exhibits high tensile strength, very high elastic modulus and high impact strength and is suitable for use at temperatures up to about 1200° F. is fabricated. An array of 304 stainless steel tubes are positioned within a 304 stainless steel can. The void spaces are filled with a particulate mixture comprising 25 volume percent boron carbide and 75 volume percent nickel aluminide (NiAl). The can, tubes and particulate mixture assembly is subjected to vacuum degassing followed by extrusion at an elevated temperature to form the article.

EXAMPLE 5

An article according to the present invention which exhibits high tensile strength, high elastic modulus and high impact resistance, and is suitable for use at temperatures up to about 2500° F. is fabricated. An array of Niobium-1 zirconium tubes are arranged within a stainless steel can. A particulate mixture of 25 volume percent titanium carbide and 75 volume percent niobium—10 titanium—5 zirconium is introduced to fill the void spaces. The can tubes and particulate mixture are subjected to vacuum degassing, followed by hot isostatic pressing and finally consolidated by extrusion at an elevated temperature from the article.

While not wishing to be bound by any particular theory, there appears to be a microstructural basis for the improved toughness exhibited by the composite article of the present invention.

Our research has indicated that discontinuous silicon carbide reinforced aluminum matrix impact specimens typically exhibit a dimpled fracture surface. Dimpled fracture surfaces are characteristic of a failure mechanism involving void initiation, void growth and void coalescence. From a toughness standpoint, this type of failure process can be mechanically interpreted as follows. A crack is initiated in the impact specimen. The crack tip produces stress and strain concentration in its vicinity that engulf the silicon carbide particles, causing the initiation of void surrounding the particles. The strain concentration in the vicinity of the crack tip causes void growth until the voids coalesce with each other and with the crack tip. The crack tip/void coalescence results in substantial crack extension and ultimately in failure of the specimen.

The basis for the improved impact resistance of the present invention is the presence of internal interfaces within the microstructure of the article. The tip of a propagating crack is blunted upon encountering such an internal interface, reducing the stress and strain concentration in the vicinity of the crack tip, thus reducing the driving force for the failure mechanism outlined above. The article of the present invention comprises a plurality of brittle reinforced regions which are compartmentalized by a plurality of ductile metallic regions. A crack propagating in any direction perpendicular to the longitudinal axis of the article in a particular reinforced region will eventually encounter a reinforced-region/-metallic-region interface. The tip of the propagating crack is blunted upon encountering the internal interface and the driving force for crack propagation is reduced. The driving force for crack propagation is further reduced since upon crossing the reinforced-region/metallic region interface the blunted crack tip encounters an unreinforced metallic region. The absence of silicon carbide particles in the unreinforced metallic region further reduces the driving force for the failure mechanism outlined above. The tip of a crack propagating through a metallic region is blunted upon encountering either a metallic-region/metallic-region interface or a metallic-region/reinforced-region interface.

The composite article of the present invention can be worked using conventional metal working techniques such as extrusion or forging, making large scale production and the production of complex shapes possible.

Although this invention has been shown and described with respect to detailed embodiments thereof, it will be understood by those skilled in the art that various changes in form and detail thereof may be made without departing from the spirit and scope of the claimed invention.

We claim:

1. A process for making a composite article, comprising:

providing a metallic container, said metallic container having a substantially continuous inner surface which extends along a first axis from an open end of the container to a closed end of the container, positioning a plurality of longitudinally extending metallic tubes along the first axis within the metallic container so that the tubes and the container define a plurality of discrete void spaces which extend along the first axis of the container, and introducing a quantity of a particulate mixture, into each of the void spaces to substantially fill each of the void spaces, said particulate mixture comprising a mixture of metallic particles and ceramic particles, and consolidating the metallic container, the metallic tubes, and the particulate mixture at elevated temperature and pressure to form the composite article.

2. A composite article made by the process of claim 1.

3. A process for making a composite article, comprising:

providing a metallic container, said metallic container having a substantially continuous inner surface which extends along a first axis from an open end of the container to a closed end of the container, positioning a plurality of longitudinally extending structural elements along the first axis within the metallic container so that the structural elements and the container define a plurality of discrete void spaces which extend along the first axis of the container, said structural elements comprising a particulate-ceramic-reinforced metal matrix composite core enclosed in a metallic sheath, or a mixture of ceramic particles and metallic particles, said particle mixture enclosed in a metallic sheath, introducing a quantity of a particulate mixture into each of the void spaces to substantially fill each of the void spaces, said particulate mixture comprising a mixture of metallic particles and ceramic particles, and consolidating the metallic container, the structural elements and the particulate mixture at elevated temperature and pressure to form the composite article.

4. A composite article made by the process of claim 3.

5. A process for making a composite article, comprising:

providing a metallic container, said metallic container having a substantially continuous inner surface which extends along a first axis of an open end of the container to a closed end of the container, positioning a plurality of longitudinally extending structural elements along the first axis within the metallic container so that the structural elements and the container define a plurality of discrete void spaces which extend along the first axis, said structural elements each comprising a particulate-ceramic-reinforced metal matrix composite core enclosed in a metallic sheath, or a particulate mixture of ceramic particles and metallic particles, said particulate mixture enclosed within a metallic sheath, introducing a quantity of metallic particles into each of the discrete void spaces to substantially fill each of the discrete void spaces, and consolidating the metallic container, the structural elements, and the metallic particles at elevated temperature and pressure to form the composite article.

6. A composite article made by the process of claim 5.

* * * * *